United States Patent [19]

Takehana et al.

[11] Patent Number: 4,840,014

[45] Date of Patent: Jun. 20, 1989

[54] PROCESS FOR PRODUCING BOTTLED BEVERAGES

[75] Inventors: Tsutomu Takehana, Sagamihara; Tetsuo Kouzai, Kouriyama; Masaaki Sagara, Kouriyama; Tamio Yaginuma, Kouriyama; Teruji Sasaki, Kouriyama, all of Japan

[73] Assignee: The Coca-Cola Company, Atlanta, Ga.

[21] Appl. No.: 215,773

[22] Filed: Jul. 6, 1988

Related U.S. Application Data

[63] Continuation-in-part of Ser. No. 935,855, Nov. 28, 1986, abandoned.

[30] Foreign Application Priority Data

Nov. 28, 1985 [JP] Japan ..... 60-266238

[51] Int. Cl.[4] ..... B65B 31/06

[52] U.S. Cl. ..... 53/432; 53/490; 141/5; 141/9

[58] Field of Search ..... 53/432, 490, 485, 403, 53/79; 141/5, 7, 9, 285, 310, 93, 70

[56] References Cited

U.S. PATENT DOCUMENTS 4,514,953 5/1985 Patzwahl ..... 53/79 X

*Primary Examiner*—James F. Coan

*Attorney, Agent, or Firm*—Birch, Stewart, Kolasch & Birch

[57] ABSTRACT

A process and apparatus for continuously producing bottled beverages and closing bottles with caps, each bottle having an externally threaded mouth and having been charged with a liquid product for drinking, the apparatus includes a timing screw for advancing bottles continuously at fixed spatial intervals, each bottle having an externally threaded mouth and having been charged with a liquid product for drinking. An inlet star wheel having a plurality of recesses at the periphery thereof at fixed spatial intervals is provided. The recesses receive bottles with externally threaded mouths that have been conveyed by the timing screw. A cap release applies caps onto the threaded mouths of bottles. A nozzle ejects a stream of a non-oxidizing gas into bottles with the nozzle being situated immediately ahead of the cap release. A capper having a plurality of recesses at the periphery thereof at fixed spatial intervals is provided. The recesses receive bottles with externally threaded mouths to which caps have been applied. The capper closes the threaded mouths of bottles with the caps while bottles with the threaded mouths are being shifted in place in the recesses. An outlet star wheel having a plurality of recesses at the periphery thereof at fixed spatial intervals is mounted adjacent to the capper. The recesses receive bottles with the threaded mouths from the capper with the externally threaded mouths closed with the caps. The preocess includes the steps of purging air from bottles with a non-oxidizing gas immediately before applying a cap to the bottle.

3 Claims, 5 Drawing Sheets

PROCESS FOR PRODUCING BOTTLED BEVERAGES

This is a continuation-in-part of application Ser. No. 935,855 filed on Nov. 28, 1986, now abandoned.

BACKGROUND OF THE INVENTION

1. Field of the Invention

This invention relates to a process and apparatus for producing bottled beverages. More specifically, it relates to a process and apparatus for efficiently purging air in the head space of the bottles containing the beverage with a non-oxidizing gas.

2. Description of Background Art

In the production of canned products, especially thin-wall-canned products, it has been proposed to apply internal pressure to the inside of the cans, thereby making the products resistant to mechanical pressure from the outside. Japanese Laid-Open Patent Publication No. 99183/77, for example, discloses a process in which before a non-sparkling beverage is charged into a metal can, the beverage is brought into contact with a mixed gas of carbon dioxide and nitrogen under pressure, thereby dissolving the mixed gas in the beverage.

Bottled products, on the other hand, generally require no such contrivance, and no proposals intended for such purposes have been made for bottled products. Japanese Patent Publication No. 23476/67 discloses a process which comprises injecting an inert gas in a liquified form into a bottle simultaneously with, or before or after, charging contents into the bottle so that the gaseous volume expansion of the liquified gas may be utilized. This process, however, is intended to prevent the deformation of a hollow, molded bottle of thermoplastic resin.

OBJECTS AND SUMMARY OF THE INVENTION

It is an object of the present invention to provide an efficient process and apparatus for purging air in the head space of the bottle of a bottled beverage with a non-oxidizing gas.

Another object is to provide an efficient process and apparatus for purging air in the head space of the bottle of a bottled beverage with a non-oxidizing gas in a procedure smoothly incorporated into a series of steps for a production process for bottled beverages.

A further object is to provide a process and apparatus for easily purging 80 to 90% of air in the head space of the bottle of a bottled beverage with a non-oxidizing gas by a very simple procedure.

The above-mentioned objects and advantages of the invention are achieved by a process for producing bottled beverages by charging a liquid product for drinking into bottles, each with an externally threaded mouth, and then applying a cap onto each threaded mouth. Air in the head space of the bottle charged with the liquid product for drinking is purged with a non-oxidizing gas immediately before the cap is applied onto the threaded mouth. The non-oxidizing gas is fed as a jet in an amount of about 1.5 to 10 times the volume of the head space toward the head space from a nozzle having an opening which is smaller than the opening of the threaded mouth.

The process includes producing bottled beverages in which air in the head space of the bottle is purged with a non-oxidizing gas. According to the process, air in the head space of the bottle with an externally threaded mouth charged with a liquid product for drinking is purged with a non-oxidizing gas immediately before a cap is applied onto the threaded mouth. Carbon dioxide or nitrogen gas is preferably used as the non-oxidizing gas. Non-carbonated or carbonated beverages may be used together with the process. Advantageously, the beverages should be beverages containing substances sensitive to oxidation, such as ascorbic acid.

Air in the space should be purged immediately before a cap is applied onto the threaded mouth of the bottle. If the time taken until the application of the cap after purge is too long, a repurging of the non-oxidizing gas with air would result, thus decreasing the rate of purge with the non-oxidizing gas. It is preferred that after purge with the non-oxidizing gas, the cap should be applied onto the threaded mouth within about 0.01 to 0.05 second.

In the process of the present invention, the non-oxidizing gas is fed as a jet from a nozzle toward the head space of the bottle. The opening of the nozzle is situated close to the opening of the bottle mouth, and is smaller than the opening of the bottle mouth. The opening of the nozzle should preferably have a top surface situated at a distance of about 0.1 to about 10 mm from the top surface of the bottle mouth. Moreover, it is advantageous that the top surface of the opening of the nozzle be substantially parallel to the top surface of the bottle mouth. Too large a distance existing between the top surface of the opening of the nozzle and the top surface of the bottle mouth tends to result in a decreased rate of purge with the non-oxidizing gas.

The area of the top surface of the opening of the nozzle is smaller than the area of the top surface of the opening of the bottle mouth. Advantageously, the opening should be about 0.2 to about 1.0 times the area of the top surface of the opening of the bottle mouth. If the area of the top surface of the opening of the nozzle is larger than the area of the top surface of the opening of the bottle mouth, there would be an increase in the amount of a wasteful non-oxidizing gas that would not take part in the purge and considerably decrease the rate of purge. Preferably, the nozzle should be a cylindrical tube having an inside diameter corresponding to about 10 to 100% of the inside diameter of the mouth of the bottle.

In addition, the nozzle should advantageously be situated such that the direction of the ejection of the jet of non-oxidizing gas will make an angle of about 20° to 90° to the top surface of the mouth of the bottle. This would permit the jet to rush into the head space along a limited zone of the inside surface of the bottle mouth, thus facilitating the purge.

The jet of the non-oxidizing gas should preferably have a linear velocity of about 5 to about 70 m/sec at the top surface of the opening of the nozzle. The time of the ejection of the jet of non-oxidizing gas is preferably within about 0.01 to about 0.5 seconds, more preferably within about 0.02 to about 0.3 seconds.

This invention also provides the following apparatus which favorably carries out the process of the invention. In detail, the apparatus is one for producing bottled beverages continuously and for closing bottles with caps. The bottles have an externally threaded mouth and are charged with a liquid product for drinking. The apparatus includes a timing screw for advancing bottles continuously at fixed spatial intervals. An inlet star wheel is provided having a plurality of recesses at the periphery thereof at fixed spatial intervals. The recesses are adapted to receive the bottles with externally threaded mouths that have been conveyed by the timing screw. A cap release is provided for applying caps onto the threaded mouths of the bottles. A nozzle ejects a stream of a non-oxidizing gas into the bottles immediately ahead of the cap release. A capper is included having a plurality of recesses at the periphery thereof fixed at spatial intervals and adapted to receive the bottles with externally threaded mouths to which caps have been applied. The capper is adapted to close the threaded mouths of the bottles with the caps while the bottles with the threaded mouths are being shifted in place in the recesses. An outlet star wheel having a plurality of recesses at the periphery thereof at fixed spatial intervals is adapted to receive the bottles with the threaded mouths from the capper. The bottles have their externally threaded mouths closed with the caps.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(*b*) is a bottom view of an embodiment of the nozzle for use in the present invention;

FIG. 4(*b*) is an exploded view of the rotary valve;

DETAILED DESCRIPTION OF THE PREFERRED EMBODIMENTS

Figure 1:
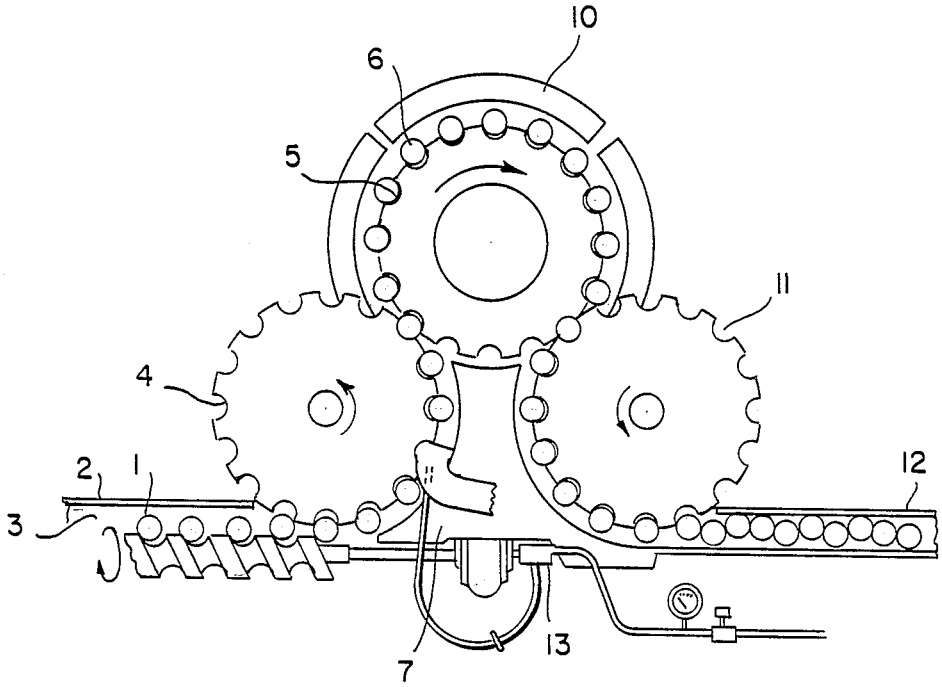
FIG. 1 is a schematic plan view of the apparatus according to the present invention.

FIG. 1 is a schematic plan view of the apparatus of the present invention. Bottles 1, each charged with a liquid beverage, are transferred from the left-hand side of the drawing by way of a path 3 equipped with a guide 2, and placed in recesses 4 of an inlet star wheel B by means of a timing screw A, as illustrated. The bottles 1 accommodated in the recesses 4 receive caps from a cap release C while being shifted along a center guide 7, and then are conveyed to a capper E. Bottles 6 with externally threaded mouths that have been capped in the capper E are shifted and situated in recesses 5 of the capper E. During this period, the bottles 6 have their externally threaded mouths closed with the caps. It should be understood that if the cap is a screw cap, the capper rotates the screw cap along the thread of the threaded mouth, thereby closing the bottle mouth with the cap. Alternatively, if the cap is a non-threaded cap, the capper deforms the cap externally along the thread of the bottle mouth, thereby converting the cap into a screw cap and closing the bottle mouth with the cap.

In the apparatus of this invention, a nozzle D for ejecting a non-oxidizing gas stream is provided immediately ahead of the cap release C. In FIG. 1, the nozzle D is provided above the inlet star wheel B. The reason is that the cap release C is provided above the inlet star wheel B. Of importance in this invention is the positioning of the cap release C and the nozzle D with respect to each other. If the cap release C is located, i.e., above the timing screw A and the bottles receive caps while being conveyed by the timing screw A, the nozzle D is situated above the timing screw A since it is located immediately ahead of the cap release C. As mentioned previously, the nozzle D is situated such that it can eject the non-oxidizing gas toward the head space of the bottle.

Figure 2:
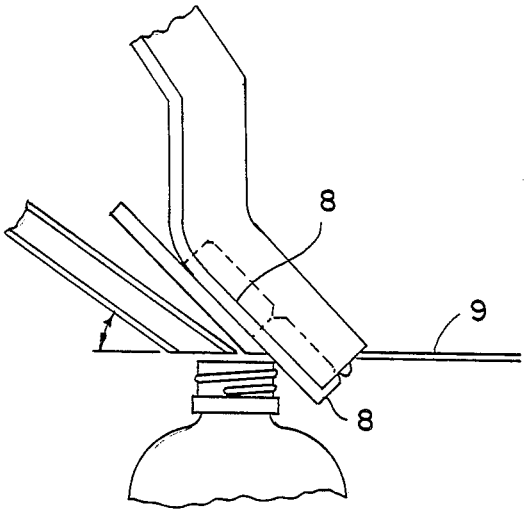
FIG. 2 is a schematic view showing the state immediately before the bottle mouth receives a cap from the cap release and illustrating the relationship between the bottle mouth and the nozzle.

FIG. 2 schematically shows the orientation of the elements immediately before the bottle mouth BM receives a cap 8 from a cap release C, in order to describe the positional relationship of the bottle mouth BM, cap release C, cap 8 and nozzle D. In this state, it is seen that the opening of the nozzle D is situated as close to the cap release C as possible, and the nozzle D is ready to eject the non-oxidizing gas toward the bottle mouth immediately before the bottle mouth BM receives the cap 8. It is noted that the opening of the nozzle is situated adjacent to the bottle mouth and is also situated in such a position that the bottle undergoes ejection of the non-oxidizing gas immediately before the mouth of the bottle is shifted from the left-hand side to the right-hand side of FIG. 2 and receives the cap 8. When the bottle moves to a further right-hand side from the state illustrated in FIG. 2, it will be understood that the bottle hits the cap 8, receives it from the cap release C, and positions the cap on the bottle. A cap press 9 (not shown in FIG. 1) is illustrated slightly apart from, or in contact with, the cap so that the cap may not be removed from the capped bottle. After the cap 8 is freed from the cap release, a cap 8′ adjacent to it is shifted by gravity to the position where the cap 8 was located for applying the cap to the next bottle.

Figure 3A:
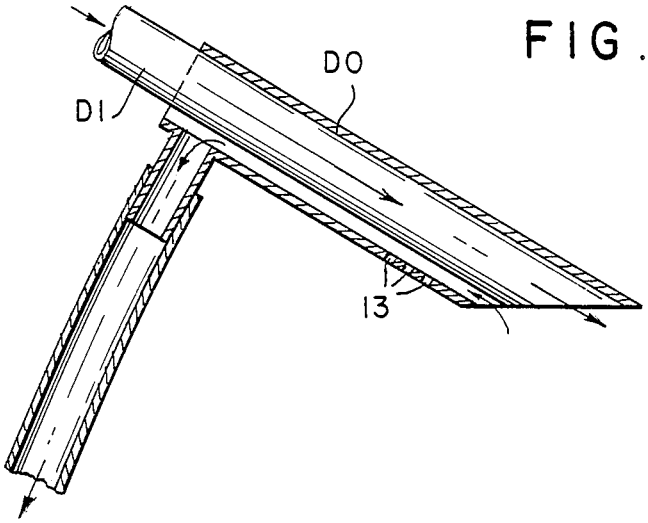
FIG. 3(*a*) is a sectional view of an embodiment of the nozzle for use in the present invention.
Figure 3B:
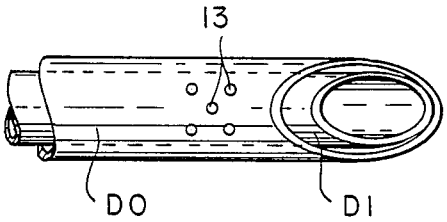

FIG. 3(*a*) shows a sectional view and FIG. 3(*b*) a bottom view of a nozzle which is different from the nozzle D illustrated in FIG. 2. The nozzle of FIGS. 3(*a*) and 3(*b*), as illustrated, is of a double structure comprising an inside channel formed by an inside duct DI, and an outside channel formed between the inside duct DI and an outside duct DO. The nozzle of FIGS. 3(*a*) and 3(*b*) ejects the non-oxidizing gas toward the bottle mouth through the inside channel as shown by the arrows, while the outside channel is used to provide a mild suction. In this embodiment, the nozzle D is used with its opening placed as close to the bottle mouth as possible, so that the liquid beverage may often spill or splash outside of the bottle. The nozzle of FIGS. 3(*a*) and 3(*b*) is effective to minimize a risk of such spills or splashes contaminating the channel for feeding the non-oxidizing gas. The spills or splashes are caused to move through the outside channel in the direction of the arrows by suction. The presence of tiny holes 13 is advantageous for sucking and removing the spills or splashes coming to the position where the tiny holes 13 are located.

Returning to FIG. 1, the invention will be described further. The bottle 6 to which the cap has been applied has its mouth closed with the cap while being shifted along a guide 10 in place in the recess 5 of the capper. Then, the closed bottle is place in a recess 1 of an outlet star wheel F, shifted along the center guide 7, and transferred onto a product path 12.

Preferred embodiments of the apparatus according to this invention will be described in regard to the nozzle (D) of the apparatus illustrated in FIG. 1.

Reviewing the apparatus of FIG. 1 will show that a certain distance corresponding to the bulge of the lower part of the bottle exists between the mouths of the adjacent bottles placed in the recesses 4 of the inlet star wheel B.

Therefore, if a jet of the non-oxidizing gas is ejected from the nozzle uninterruptedly in the apparatus of this embodiment, there will clearly be a large loss of the non-oxidizing gas that will take no part in the purging of air in the head space.

According to a preferred embodiment of the present invention, the nozzle is connected with a rotary valve, and the intervals of ejection of a jet of the non-oxidizing gas from the nozzle are controlled by the rotary valve. The rotary valve is designed to form a flow channel for the non-oxidizing gas each time the rotor makes a rotation. This design permits the non-oxidizing gas not to be ejected when the opening of the nozzle is situated between the adjacent bottle mouths, and allows the non-oxidizing gas to be ejected when the opening of the nozzle is positioned above the bottle mouth. In FIG. 1, the rotary valve 13 is connected with the timing screw A. The rotary valve rotates periodically according to the periodical rotation of the timing screw, permitting the non-oxidizing gas to be ejected intermittently at fixed time intervals from the nozzle D connected with the rotary valve. Referring to FIG. 1, for instance, one rotation of the timing screw A causes the inlet star wheel B to rotate by one of its recesses. Thus, one rotation of the timing screw A leads to one rotation of the rotor of the rotary valve. When the bottle mouth comes below the opening of the nozzle D during one rotation of the rotor, a flow channel for the non-oxidizing gas if formed. This is an easy mechanism to utilize with the present invention, thus making the consumption of the non-oxidizing gas very small.

Figures 4A, 4B:
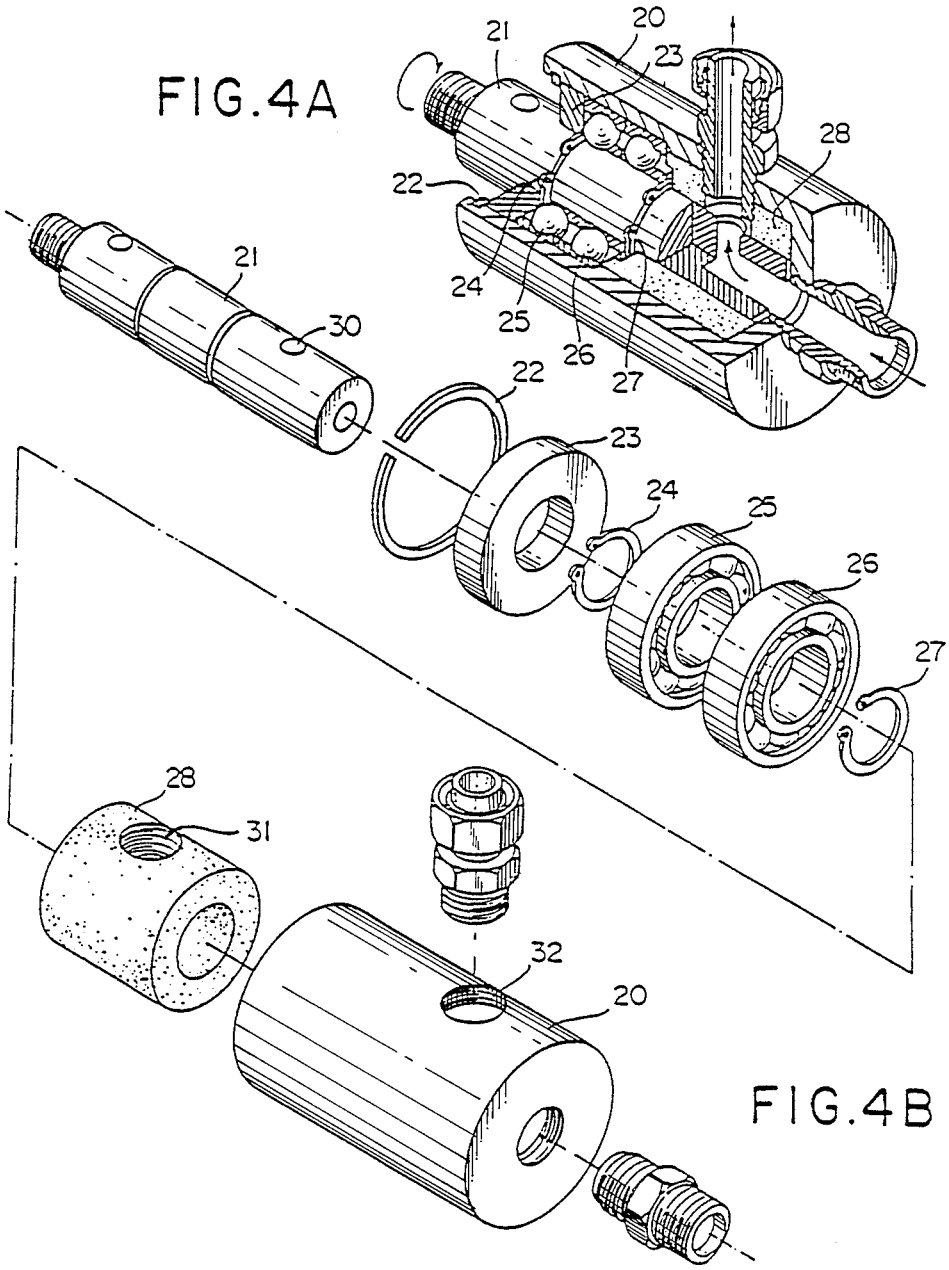
FIG. 4(*a*) is a partially cutaway view of the rotary valve for use the execution of the present invention.

FIGS. 4(*a*) and 4(*b*) show a partially cutaway view and an exploded view of an example of the rotary valve. In FIGS. 4(*a*) and 4(*b*) a valve body 20, a rotor 21, a snap ring 22, an oil seal 23, snap rings 24 and 27, ball bearings 25 and 26, and an inside cylinder 28 of a solid lubricating material such as Teflon resin are provided. When an opening 30 of the rotor 21 aligns with an opening 31 of the cylinder 28 and an opening 32 of the valve body 20 while the rotor 21 is making a rotation, a flow channel for the non-oxidizing gas is formed as shown by the arrows in FIG. 4(*a*).

Figure 5:
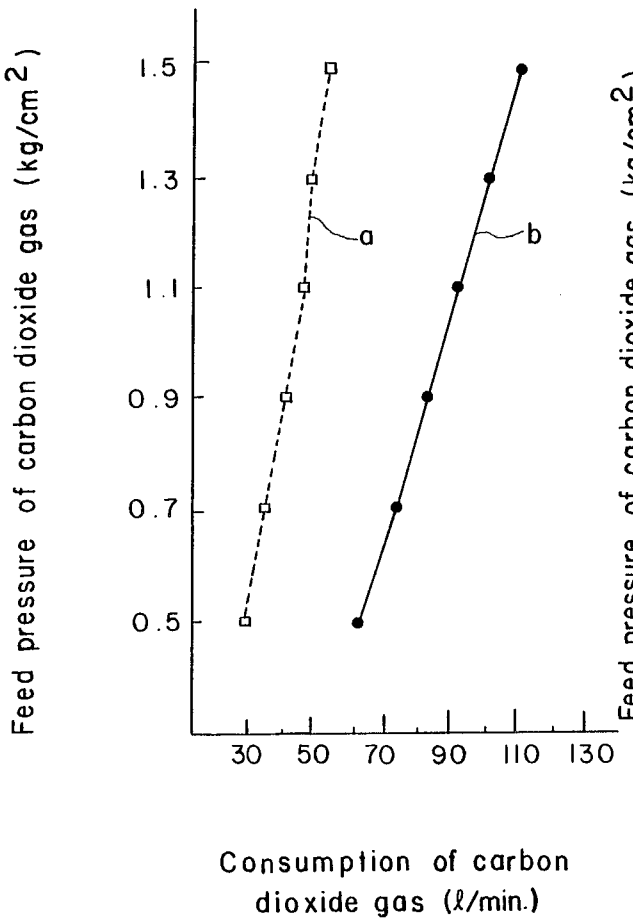
FIG. 5 is a graph showing the relationship between the feed pressure of carbon dioxide gas and the consumption of carbon dioxide gas.
Figure 6:
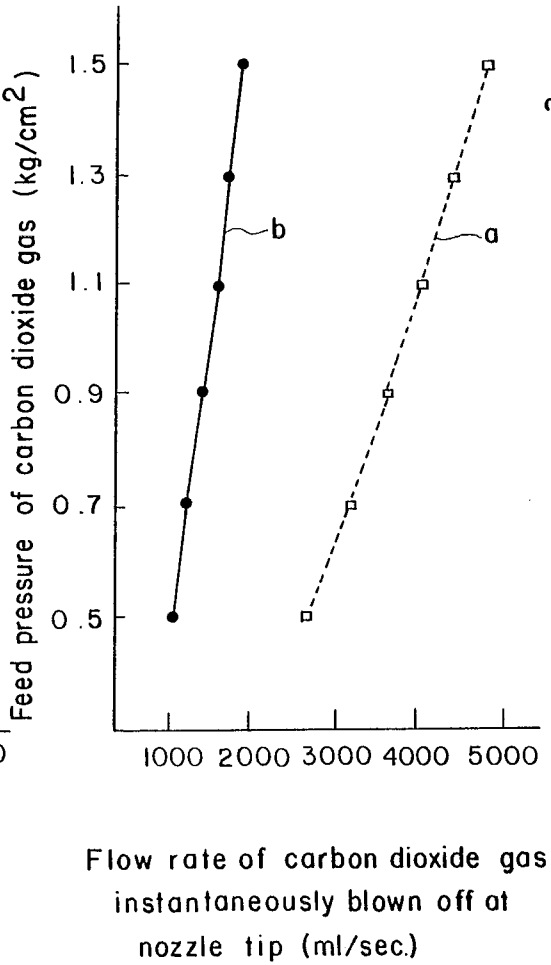
FIG. 6 is a graph showing the relationship between the feed pressure of carbon dioxide gas and the flow rate of carbon dioxide gas instantaneously blown off at the tip of the nozzle.
Figure 7:
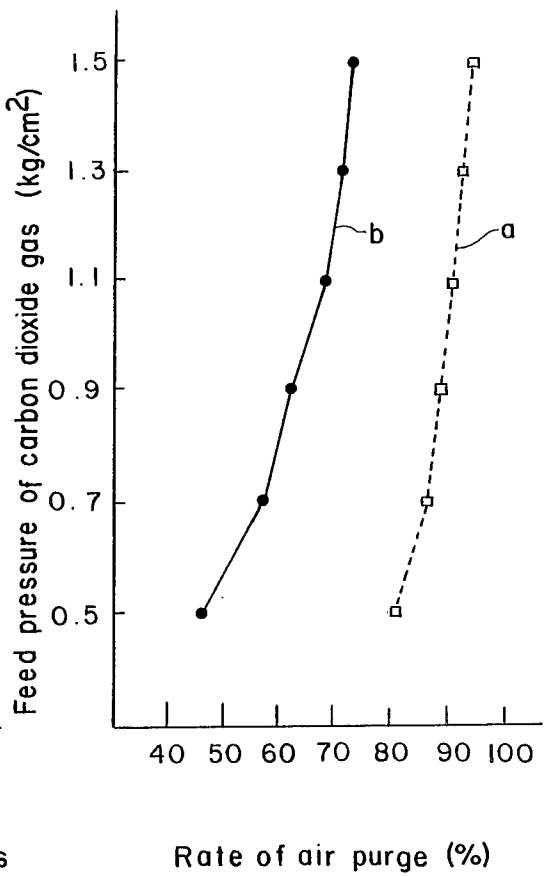
FIG. 7 is a graph showing the relationship between the feed pressure of carbon dioxide gas and the rate of air purge.

FIGS. 5 to 9 give comparisons of the results obtained when the rotary valve shown in FIGS. 4(*a*) and 4(*b*) was used and connected with the timing screw A as in FIG. 1, the intermittent ejection is illustrated by curve a. When the rotary valve was not used, uninterrupted blow-off is illustrated by curve b. The results were obtained using a non-rigid polyethylene tube 10 mm in diameter as a nozzle for a bottle with a 28 mm mouth. For use as a nozzle, the tube was cut so that the resulting nozzle when set in place made an angle of 25° to 30° to the horizontal and the top surface of the opening of the nozzle was parallel to the top surface of the bottle mouth. FIGS. 5, 6 and 7 taken together show that when the feed pressure of carbon dioxide gas used as the non-oxidizing gas is constant, intermittent ejection (curve a), compared with uninterrupted blow-off (curve b), decreases carbon dioxide gas consumption to about a half (FIG. 5), increases instantaneous blow-off pressure to about 2.5 times (FIG. 6), and increases the rate of purge of air in the head space by about 25% to about 80 to 90% (FIG. 7).

Figure 8:
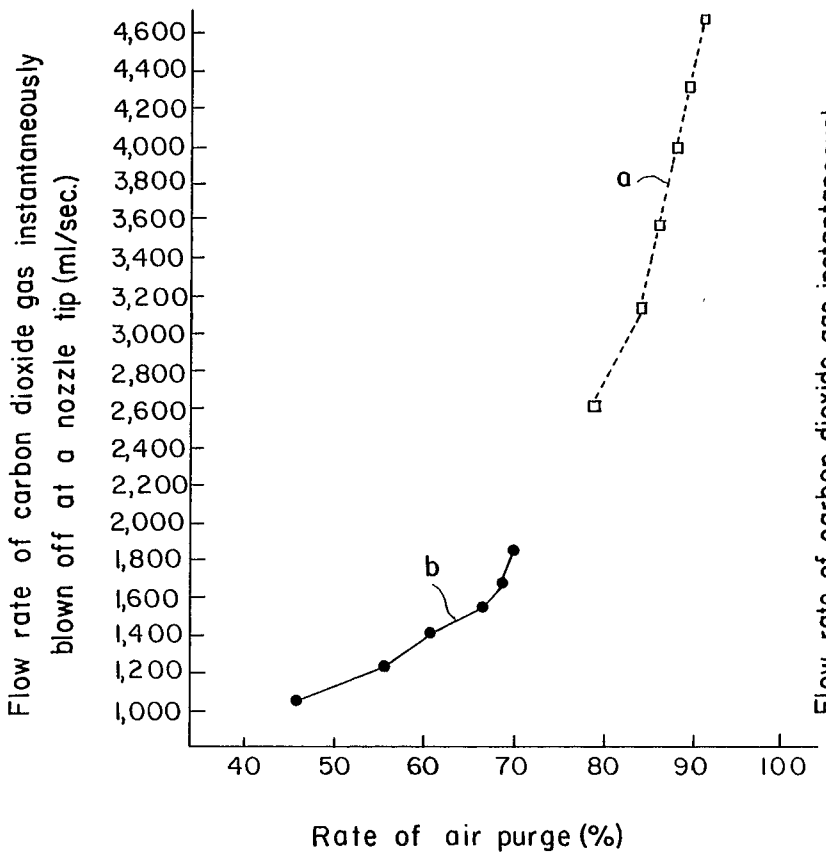
FIGS. 8 and 9 are graphical representations of the relationships of the rate of air purge and the consumption of carbon dioxide gas to the flow rate of carbon dioxide gas instantaneously blown off at the tip of the nozzle, respectively.
Figure 9:
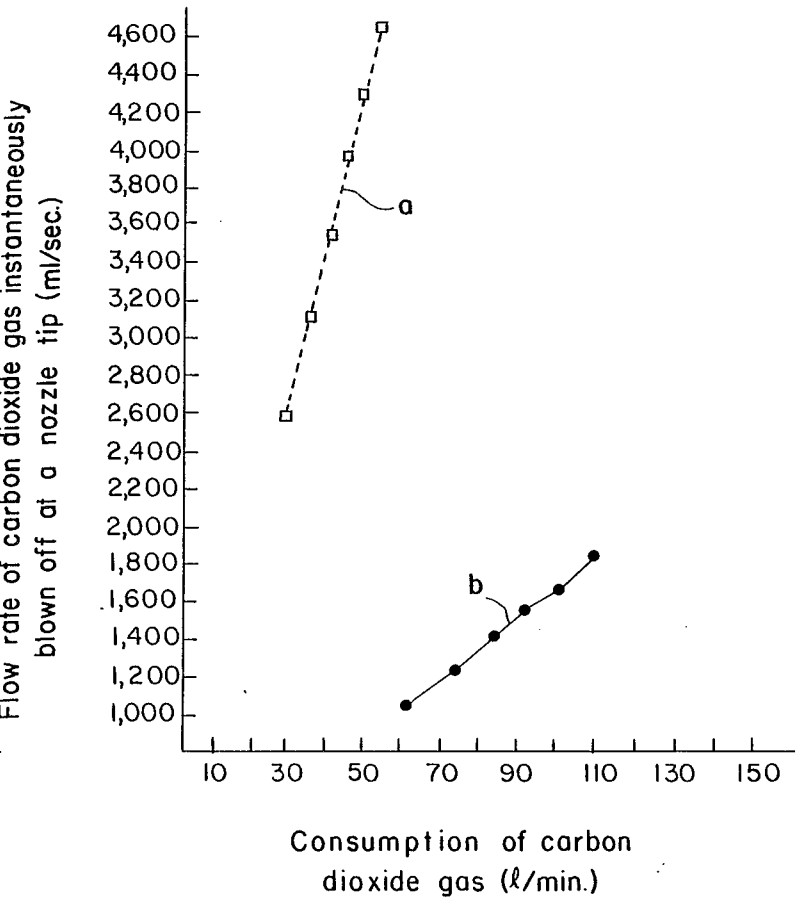

The results revealed in FIGS. 8 and 9 were obtained by compiling the results of FIGS. 5 to 7 from different aspects. FIGS. 8 and 9 show that the increase in the rate of purge of air in the head space and the decrease in the consumption of carbon dioxide gas are closely related to the increase in the flow rate of carbon dioxide gas instantaneously blown off at the tip of the nozzle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for producing bottled beverages comprising the following steps:

charging a liquid product for drinking into a plurality of bottles, each with an externally threaded mouth;

purging air in the head space of each bottle charged with the liquid product for drinking with a non-oxidizing gas, said non-oxidizing gas being fed as a pulsed jet in an amount of 1.5 to 10 times the volume of the head space toward the mouth through a cylindrical tube having an inside diameter corresponding to approximately 10 to 100% of the inside diameter of the mouth, the top surface of the opening of said cylindrical tube being positioned at a distance of 0.1 to 10 mm from the top surface of the mouth and being substantially parallel to the top surface of the mouth, wherein the direction of ejection of the pulsed jet of non-oxidizing gas is at an angle of 20° to 90° with respect to the top surface of the mouth; and applying a cap onto the threaded mouth of the bottle within 0.01 to 0.05 seconds after purging.

2. The process according to claim 1, wherein said non-oxidizing gas is carbon dioxide gas.

3. The process according to claim 1, wherein said non-oxidizing gas is nitrogen gas.

* * * * *